US005938489A

United States Patent [19]

Mc Neil

[11] Patent Number: 5,938,489

[45] Date of Patent: Aug. 17, 1999

[54] LEG-POWERED BOAT

[76] Inventor: James A. Mc Neil, 6155 Monadnock Way, Oakland, Calif. 94605

[21] Appl. No.: 09/168,107

[22] Filed: Oct. 8, 1998

[51] Int. Cl.[6] ..... B63H 16/00

[52] U.S. Cl. ..... 440/21; 440/24; 440/17

[58] Field of Search ..... 440/13, 17–21, 440/24, 32, 28, 29

[56] References Cited

U.S. PATENT DOCUMENTS

| | | | |
|---|---|---|---|
| 780,071 | 1/1905 | Stasny | 440/24 |
| 2,056,475 | 10/1936 | Marx | 440/24 |
| 3,369,517 | 2/1968 | Rosenthal | 440/25 |

*Primary Examiner*—Ed L. Swinehart

[57] ABSTRACT

A new leg-powered boat for propelling through water by using one's legs. The inventive device includes a boat portion defined by an open upper end, a closed lower end, forward and rearward ends, and opposed side walls extending between the forward and rearward ends. The closed lower end has an interior surface. The interior surface has a rail that extends a portion of a length of the interior surface. The rail has a channel formed therein extending a length of the rail. A seat portion is slidably coupled with respect to the boat portion. The seat portion has a lower portion and an upper portion. The lower portion has a bracket that extends through the channel. A pulley system has a plurality of pulleys and a cable that extends around the pulleys. The cable is coupled to the bracket of the seat portion. The closed lower end of the boat portion has a track that extends therein from a lower surface of the closed lower end. A flap portion is slidably disposed in the track of the closed lower end of the boat portion and is coupled to the cable of the pulley system.

16 Claims, 3 Drawing Sheets

26
24

18
14
16
28
34
42
38
36
40

LEG-POWERED BOAT

BACKGROUND OF THE INVENTION

1. Field of the Invention

The present invention relates to boat propulsion mechanisms and more particularly pertains to a new leg-powered boat for propelling through water by using one's legs.

2. Description of the Prior Art

The use of boat propulsion mechanisms is known in the prior art. More specifically, boat propulsion mechanisms heretofore devised and utilized are known to consist basically of familiar, expected and obvious structural configurations, notwithstanding the myriad of designs encompassed by the crowded prior art which have been developed for the fulfillment of countless objectives and requirements.

Known prior art boat propulsion mechanisms include U.S. Pat. No. 5,381,752 to Eerdmans; U.S. Pat. No. 5,183,422 to Guiboche; U.S. Pat. No. 5,000,706 to Wang; U.S. Pat. No. Des. 359,940 to Gagnier; U.S. Pat. No. 5,021,015 to Wang; and U.S. Pat. No. 5,042,416 to Arcouette.

While these devices fulfill their respective, particular objectives and requirements, the aforementioned patents do not disclose a new leg-powered boat. The inventive device includes a boat portion defined by an open upper end, a closed lower end and opposed side walls. Forward and rearward ends of the opposed side walls merge to form forward and rearward ends. An interior surface of the closed lower end has a rail extending a portion of a length thereof. The rail has a channel formed therein extending a length thereof. A seat portion is slidably coupled with respect to the boat portion. The seat portion has a lower portion and an upper portion. The lower portion has a plurality of wheels disposed on a lower surface thereof. The plurality of wheels are disposed on the rail. The lower portion has a pair of brackets extending through the channel. A pulley system is disposed within the boat portion below the rail therein. The pulley system includes a pair of large rear pulleys and a single front pulley. The pulley system includes a cable extending around the rear pulleys and the front pulley. The cable engages the pair of brackets of the seat portion. A flap portion extends inwardly of the closed lower end of the boat portion and pivotally coupling with the cable of the pulley system.

In these respects, the leg-powered boat according to the present invention substantially departs from the conventional concepts and designs of the prior art, and in so doing provides an apparatus primarily developed for the purpose of propelling through water by using one's legs.

SUMMARY OF THE INVENTION

In view of the foregoing disadvantages inherent in the known types of boat propulsion mechanisms now present in the prior art, the present invention provides a new leg-powered boat construction wherein the same can be utilized for propelling through water by using one's legs.

The general purpose of the present invention, which will be described subsequently in greater detail, is to provide a new leg-powered boat apparatus and method which has many of the advantages of the boat propulsion mechanisms mentioned heretofore and many novel features that result in a new leg-powered boat which is not anticipated, rendered obvious, suggested, or even implied by any of the prior art boat propulsion mechanisms, either alone or in any combination thereof.

To attain this, the present invention generally comprises a boat portion defined by an open upper end, a closed lower end, forward and rearward ends, and opposed side walls extending between the forward and rearward ends. The closed lower end has an interior surface. The interior surface has a rail that extends a portion of a length of the interior surface. The rail has a channel formed therein extending a length of the rail. A seat portion is slidably coupled with respect to the boat portion. The seat portion has a lower portion and an upper portion. The lower portion has a bracket that extends through the channel. A pulley system has a plurality of pulleys and a cable that extends around the pulleys. The cable is coupled to the bracket of the seat portion. The closed lower end of the boat portion has a track that extends therein from a lower surface of the closed lower end. A flap portion is slidably disposed in the track of the closed lower end of the boat portion and is coupled to the cable of the pulley system.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new leg-powered boat apparatus and method which has many of the advantages of the boat propulsion mechanisms mentioned heretofore and many novel features that result in a new leg-powered boat which is not anticipated, rendered obvious, suggested, or even implied by any of the prior art boat propulsion mechanisms, either alone or in any combination thereof.

It is another object of the present invention to provide a new leg-powered boat which may be easily and efficiently manufactured and marketed.

It is a further object of the present invention to provide a new leg-powered boat which is of a durable and reliable construction.

An even further object of the present invention is to provide a new leg-powered boat which is susceptible of a low cost of manufacture with regard to both materials and labor, and which accordingly is then susceptible of low prices of sale to the consuming public, thereby making such leg-powered boat economically available to the buying public.

Still yet another object of the present invention is to provide a new leg-powered boat which provides in the apparatuses and methods of the prior art some of the advantages thereof, while simultaneously overcoming some of the disadvantages normally associated therewith.

Still another object of the present invention is to provide a new leg-powered boat for propelling through water by using one's legs.

Yet another object of the present invention is to provide a new leg-powered boat which includes a boat portion defined by an open upper end, a closed lower end, forward and rearward ends, and opposed side walls extending between the forward and rearward ends. The closed lower end has an interior surface. The interior surface has a rail that extends a portion of a length of the interior surface. The rail has a channel formed therein extending a length of the rail. A seat portion is slidably coupled with respect to the boat portion. The seat portion has a lower portion and an upper portion. The lower portion has a bracket that extends through the channel. A pulley system has a plurality of pulleys and a cable that extends around the pulleys. The cable is coupled to the bracket of the seat portion. The closed lower end of the boat portion has a track that extends therein from a lower surface of the closed lower end. A flap portion is slidably disposed in the track of the closed lower end of the boat portion and is coupled to the cable of the pulley system.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
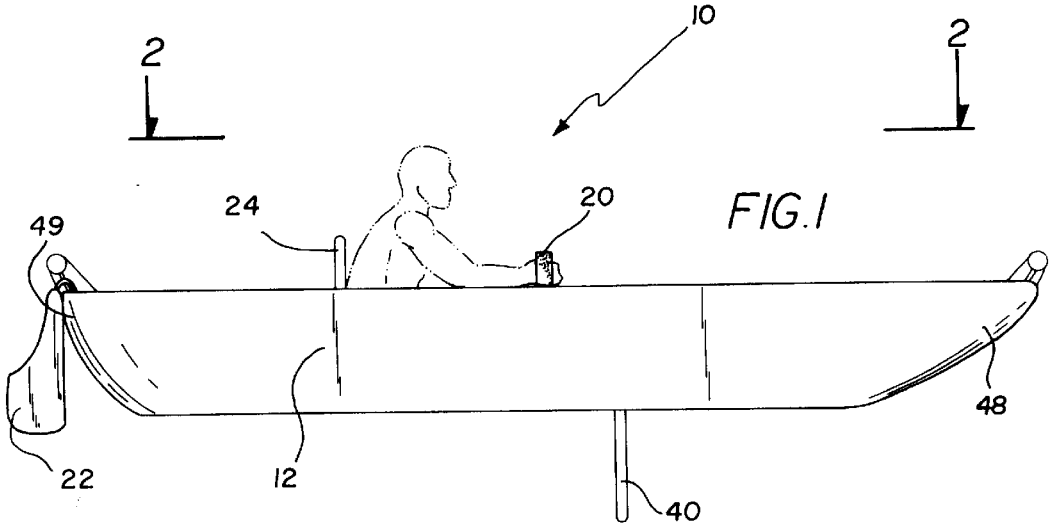
FIG. 1 is a side view of a new leg-powered boat according to the present invention.
Figure 2:
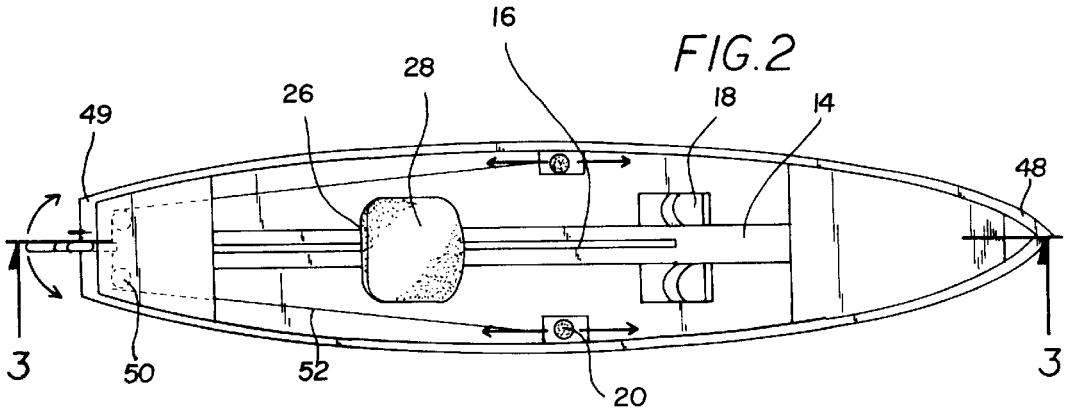
FIG. 2 is a top plan view of the present invention as taken along line 2—2 of FIG. 1.
Figure 3:
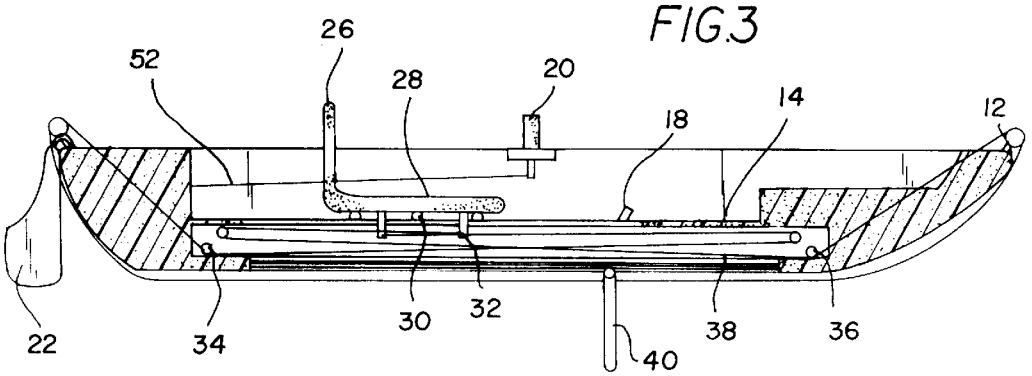
FIG. 3 is a cross-sectional view of the present invention as taken along line 3—3 of FIG. 2.
Figure 4:
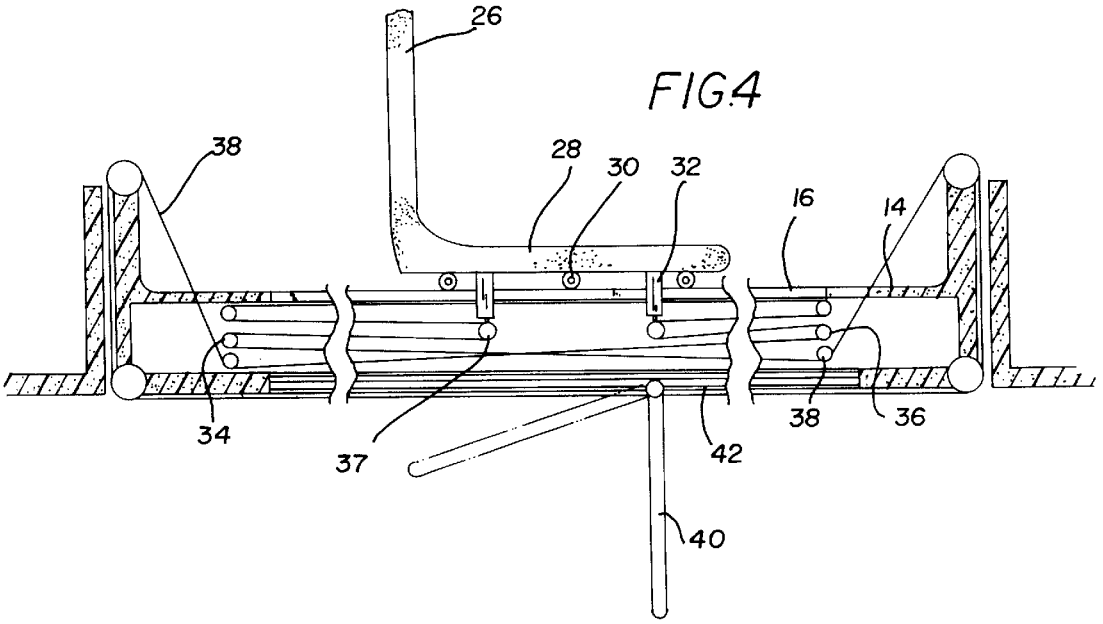
FIG. 4 is a partial cross-sectional view of the present invention.

With reference now to the drawings, and in particular to FIGS. 1 through 5 thereof, a new leg-powered boat embodying the principles and concepts of the present invention and generally designated by the reference numeral 10 will be described.

As best illustrated in FIGS. 1 through 5, the leg-powered boat 10 comprises a boat portion 12 defined by an open upper end, a closed lower end, forward and rearward ends 48,49, and opposed side walls extending between the forward and rearward ends 48,49. The closed lower end has an interior surface. The interior surface has a rail 14 that extends a portion of a length of the interior surface. The rail 14 has a channel 16 formed therein extending a length of the rail 14. A seat portion 24 is slidably coupled with respect to the boat portion. The seat portion 24 has an upper portion 26 and a lower portion 28. The lower portion 28 has at least one bracket 32 that extends through the channel 16. A pulley system has a plurality of pulleys and a cable 38 that extends around the pulleys. The cable is coupled to the bracket 32 of the seat portion 24. The closed lower end of the boat portion 12 has a track 42 that extends therein from a lower surface of the closed lower end. A flap portion 40 is slidably disposed in the track 42 of the closed lower end of the boat portion and is coupled to the cable of the pulley system.

Preferably, a pair of foot pedals 18 are secured to the rail 14 on opposing sides of the rail 14 inwardly of the forward end 48 of the boat portion 12. The foot pedals 18 provide a solid base upon which feet may rest and push off of without slipping.

Also preferably, each of the opposed side walls has a gripping handle 20 coupled to it towards a central portion of the side wall. Ideally, the gripping handles 20 are pivotally coupled to the side walls and operatively coupled to a rudder portion 22 to permit steering of the boat 10 as it moves through water. In such an embodiment, the rudder portion 22 is pivotally coupled to the rearward end 49 of the boat portion. A pair of steering pulleys 50 are positioned towards the rearward end 49 of the boat portion. A steering cable 52 is coupled to the gripping handles 20 and rudder portion 22 and extends around the steering pulleys 50. The rudder portion 22 pivots when the gripping handles 20 are pivoted in opposite directions relative to each other.

Preferably, the lower portion 28 of the seat portion 24 has a plurality of wheels 30 coupled to a lower surface of the seat portion 24. The plurality of wheels 30 are disposed on the rail 14 of the interior surface of the closed lower end of the boat portion 12. The wheels 30 assist the seat portion 24 in sliding along the rail 14.

Preferably, the flap portion 40 is pivotable between a deployed position and a retracted position. The flap portion 40 is positioned substantially perpendicular to the closed lower end of the boat portion 12 when the flap portion 40 is in the deployed position, and is positioned substantially parallel the closed lower end of the boat portion 12 when the flap portion 40 is in the retracted position.

Also preferably, the flap portion 40 moves towards the deployed position and travels toward the rearward end 49 of the boat portion 12 when the seat portion 24 travels towards the rearward end 49 of the boat portion 12. The flap portion 40 moves towards the retracted position and travels toward the forward end 48 of the boat portion 12 when the seat portion 24 travels towards the forward end 48 of the boat portion 12.

Preferably, the pulley system comprises a plurality of rear pulleys 34, a plurality of front pulleys 36, and a pair of seat pulleys 37 that are coupled to the brackets 32 of the seat portion 24. The cable 38 extends around the rear pulleys 34, the front pulleys 36, and the seat pulleys 37. Ideally, the ratio of movement between the flap portion 40 and the seat portion 24 is between about 1.5 to 1 and 4 to 1.

In use, the individual would simply climb into the seat portion 24 and push with both legs against the foot pedals 18. By forcing the seat portion 24 rearwardly, the flap portion 40 would be moved rearwardly to force the boat portion 12 forward. Once the seat portion 12 is slid back, it could be designed to automatically return to the front or could be pulled forward by the user grasping and pulling himself and the seat forward by the gripping handles 20. The flap portion 40 would be shifted to a horizontal orientation beneath the hull during this return action to minimize resistance. The individual could push as hard or frequently as desired to propel the boat portion 12 through the water. Also, for example, the pulley system could provide about a 2:1 ratio of movement of the flap portion 40 with respect to the seat portion 12 movement, creating a high rate of speed through the water. The gripping handles 20 would also allow precise steering while the operator faces the intended direction of travel. Optionally, a variable gearing pulley system could be included to move at a lower ratio to move at low speeds and at higher speeds at a higher ratio to achieve maximum speed.

Figure 5:
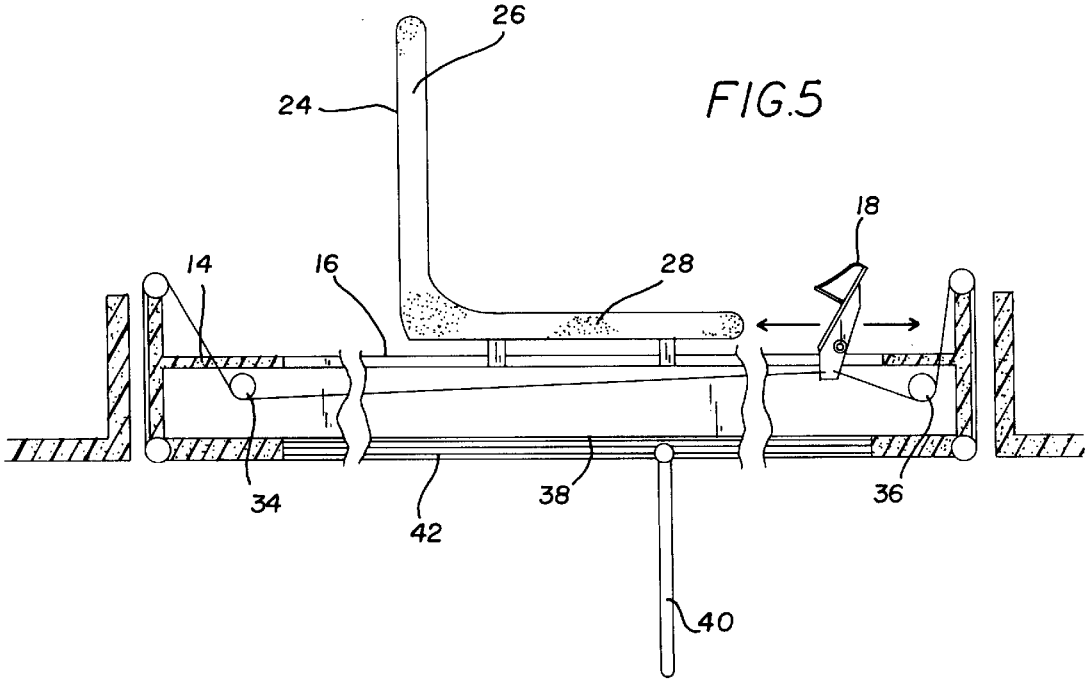
FIG. 5 is a cross-sectional view of an alternate embodiment of the present invention.

In an alternate embodiment, as illustrated in FIG. 5, the seat portion 24 is fixed with respect to the boat portion 12 and at least one foot pedal 18 is slidably disposed within the channel 16 and engaged to the cable 38 of the pulley system. Thus, the seat portion 24 would not move, but merely the foot pedal 18 would slide.

Preferably, the pulley system would comprise a plurality of rear pulleys 34 and a plurality of front pulleys 36. A pair of pedal pulleys (not shown) may be coupled to the foot pedal 18 to increase the ratio of movement between the foot pedal 18 and the flap portion 40. The cable 38 would extend around the rear 34, front 36, and pedal pulleys. Ideally, the ratio of movement between the flap portion 40 and the foot pedal 18 is between about 1.5 to 1 and 5 to 1. Also ideally, the foot pedal 18 is biased towards the user so that it returns to a ready position after each stroke.

Additionally, the seat portion 24 could be constructed to accommodate more than one person. Furthermore, a motor (not shown) could be provided to operate the pulley system.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A leg-powered boat for propelling through water by using one's legs comprising, in combination:

a boat portion defined by an open upper end, a closed lower end, forward and rearward ends, and opposed side walls extending between said forward and rearward ends;

said closed lower end of said boat portion having an interior surface, said interior surface having a rail extending a portion of a length thereof, said rail having a channel formed therein extending a length thereof;

said rail having a pair of foot pedals secured thereto on opposing sides thereof inwardly of said forward end of said boat portion;

said opposed side walls of said boat portion each having a gripping handle being pivotally coupled thereto at central portions thereof;

said rearward end of said boat portion having a rudder portion pivotally coupled thereto;

a pair of steering pulleys being positioned towards said rearward end of said boat portion;

a steering cable being coupled to said gripping handles and extending around said steering pulleys, said steering cable being coupled to said rudder portion, said rudder portion being pivoted when said gripping handles are pivoted in opposite directions relative to each other;

a seat portion slidably coupled with respect to said boat portion, said seat portion having a lower portion and an upper portion, said lower portion of said seat portion having a plurality of wheels coupled to a lower surface thereof, said plurality of wheels being disposed on said rail of said interior surface of said closed lower end of said boat portion, said lower portion of said seat portion having a pair of brackets extending through said channel;

a pulley system having a plurality of rear pulleys, a plurality of front pulleys, and a pair of seat pulleys being coupled to said brackets of said seat portion, said pulley system including a cable extending around said rear pulleys, said front pulleys, and said seat pulleys, said cable being coupled to said pair of brackets of said seat portion;

said closed lower end of said boat portion having a track extending therein from a lower surface thereof;

a flap portion being slidably disposed in said track of said closed lower end of said boat portion, said flap portion being coupled to said cable of said pulley system;

wherein said flap portion is pivotable between a deployed position and a retracted position, said flap portion being positioned substantially perpendicular to said closed lower end of said boat portion when said flap portion is in said deployed position, said flap portion being positioned substantially parallel said closed lower end of said boat portion when said flap portion is in said retracted position;

wherein said flap portion moves towards said deployed position and travels toward said rearward end of said boat portion when said seat portion travels towards said rearward end of said boat portion; and wherein said flap portion moves towards said retracted position and travels toward said forward end of said boat portion when said seat portion travels towards said forward end of said boat portion.

2. A leg-powered boat for propelling through water by using one's legs comprising, in combination:

a boat portion defined by an open upper end, a closed lower end, forward and rearward ends, and opposed side walls extending between said forward and rearward ends;

said closed lower end of said boat portion having an interior surface, said interior surface having a rail extending a portion of a length thereof, said rail having a channel formed therein extending a length thereof;

a seat portion slidably coupled with respect to said boat portion, said seat portion having a lower portion and an upper portion, said lower portion of said seat portion having a bracket extending through said channel;

a pulley system having a plurality of pulleys and a cable extending around said pulleys, said cable being coupled to said bracket of said seat portion;

said closed lower end of said boat portion having a track extending therein from a lower surface thereof; and a flap portion being slidably disposed in said track of said closed lower end of said boat portion, said flap portion being coupled to said cable of said pulley system.

3. The leg-powered boat as set forth in claim 2, wherein said rail has a pair of foot pedals secured thereto on opposing sides thereof inwardly of said forward end of said boat portion.

4. The leg-powered boat as set forth in claim 2, wherein each of said opposed side walls of said boat portion has a gripping handle being coupled thereto at central portions thereof.

5. The leg-powered boat as set forth in claim 4, further comprising a pair of steering pulleys and a steering cable, said rearward end of said boat portion having a rudder portion pivotally coupled thereto, said gripping handles being pivotally coupled to said side walls of said boat portion, said pair of steering pulleys being positioned towards said rearward end of said boat portion, said steering cable being coupled to said gripping handles and extending around said steering pulleys, said steering cable being coupled to said rudder portion, said rudder portion being pivoted when said gripping handles are pivoted in opposite directions relative to each other.

6. The leg-powered boat as set forth in claim 2, wherein said lower portion of said seat portion has a plurality of wheels coupled to a lower surface thereof, said plurality of wheels being disposed on said rail of said interior surface of said closed lower end of said boat portion.

7. The leg-powered boat as set forth in claim 2, wherein said flap portion is pivotable between a deployed position and a retracted position, said flap portion being positioned substantially perpendicular to said closed lower end of said boat portion when said flap portion is in said deployed position, said flap portion being positioned substantially parallel said closed lower end of said boat portion when said flap portion is in said retracted position.

8. The leg-powered boat as set forth in claim 7, wherein said flap portion moves towards said deployed position and travels toward said rearward end of said boat portion when said seat portion travels towards said rearward end of said boat portion, wherein said flap portion moves towards said retracted position and travels toward said forward end of said boat portion when said seat portion travels towards said forward end of said boat portion.

9. The leg-powered boat as set forth in claim 2, wherein said pulley system comprises a plurality of rear pulleys, a plurality of front pulleys, and a pair of seat pulleys being coupled to said brackets of said seat portion, said cable extending around said rear pulleys, said front pulleys, and said seat pulleys.

10. The leg-powered boat as set forth in claim 9, wherein the ratio of movement between said flap portion and said seat portion is between about 1.5 to 1 and 4 to 1.

11. A leg-powered boat for propelling through water by using one's legs comprising, in combination:

a boat portion defined by an open upper end, a closed lower end, forward and rearward ends, and opposed side walls extending between said forward and rearward ends;

said closed lower end of said boat portion having an interior surface, said interior surface having a rail extending a portion of a length thereof, said rail having a channel formed therein extending a length thereof;

a foot pedal being extended through said channel and being slidably coupled to said rail;

a pulley system having a plurality of pulleys and a cable extending around said pulleys, said cable being coupled to said foot pedal;

said closed lower end of said boat portion having a track extending therein from a lower surface thereof;

a flap portion being slidably disposed in said track of said closed lower end of said boat portion, said flap portion being coupled to said cable of said pulley system;

wherein said flap portion is pivotable between a deployed position and a retracted position, said flap portion being positioned substantially perpendicular to said closed lower end of said boat portion when said flap portion is in said deployed position, said flap portion being positioned substantially parallel said closed lower end of said boat portion when said flap portion is in said retracted position; and wherein said flap portion moves between said deployed and said retracted positions and travels between said forward and rearward ends of said boat portion when said foot pedal is slidably moved.

12. The leg-powered boat as set forth in claim 11, wherein each of said opposed side walls of said boat portion has a gripping handle being coupled thereto at central portions thereof.

13. The leg-powered boat as set forth in claim 12, further comprising a pair of steering pulleys and a steering cable, said rearward end of said boat portion having a rudder portion pivotally coupled thereto, said gripping handles being pivotally coupled to said side walls of said boat portion, said pair of steering pulleys being positioned towards said rearward end of said boat portion, said steering cable being coupled to said gripping handles and extending around said steering pulleys, said steering cable being coupled to said rudder portion, said rudder portion being pivoted when said gripping handles are pivoted in opposite directions relative to each other.

14. The leg-powered boat as set forth in claim 11, further comprising a seat portion being coupled to said interior surface of said closed lower end of said boat portion.

15. The leg-powered boat as set forth in claim 11, wherein said pulley system comprises a plurality of rear pulleys, a plurality of front pulleys, and a pair of pedal pulleys being coupled to said foot pedal, said cable extending around said rear pulleys, said front pulleys, and said pedal pulleys.

16. The leg-powered boat as set forth in claim 15, wherein the ratio of movement between said flap portion and said foot pedal is between about 1.5 to 1 and 5 to 1.

* * * * *